US005590877A

United States Patent [19]

Ho

[11] Patent Number: 5,590,877

[45] Date of Patent: Jan. 7, 1997

[54] RACKET STRING BRACING APPARATUS

[76] Inventor: Ping-Sen Ho, P.O. Box 82-144, Taipei, Taiwan

[21] Appl. No.: 646,091

[22] Filed: May 7, 1996

[51] Int. Cl.[6] ..... A63B 51/14

[52] U.S. Cl. ..... 473/556

[58] Field of Search ..... 273/73 R, 73 A, 273/73 B

[56] References Cited

U.S. PATENT DOCUMENTS

| | | | |
|---|---|---|---|
| 1,916,699 | 7/1933 | Tauber et al. | 273/73 B |
| 2,309,849 | 2/1943 | Kausal et al. | 273/73 A |
| 3,511,502 | 5/1970 | Spenle | 273/73 A |
| 4,417,729 | 11/1983 | Morrone | 273/73 A |
| 5,186,505 | 2/1993 | Chu | 273/73 A |

FOREIGN PATENT DOCUMENTS

| | | | |
|---|---|---|---|
| 3326261 | 1/1985 | Germany | 273/73 A |
| 4211837 | 10/1993 | Germany | 273/73 A |

*Primary Examiner*—William E. Stoll
*Attorney, Agent, or Firm*—Alfred Lei

[57] ABSTRACT

A racket string bracing apparatus including a base having a column sleeve at one end and a U-shaped upright support at an opposite end, a work table turned about the column sleeve, internal racket frame holders and external racket frame holders respectively mounted on the work table to hold down the racket frame to be strung, a string bracing mechanism mounted on the upright support and controlled to brace the string, wherein a pawl and a gear are mounted in the string bracing mechanism to prohibit it from reverse rotation; each of the external racket frame holders includes a slide slidably mounted on the work table and fixed in place by a tightening up screw, a transverse sleeve welded to the slide, two horizontal extension bars respectively and longitudinally slidably inserted into two opposite ends of the transverse sleeve and fixed in place by a respective tightening up screw, and two stop rods respectively perpendicularly fastened to the horizontal extension bars at respective locations remote from the transverse sleeve.

1 Claim, 8 Drawing Sheets

RACKET STRING BRACING APPARATUS

BACKGROUND OF THE INVENTION

1. Field of the Invention

This invention is related to a racket string bracing apparatus adapted for use to brace the string of a racket which can be conveniently adjusted to hold down the racket frame to be strung, and easily operated to brace the string with less effort.

2. Description of the Prior Art

FIG. 1 shows a racket string bracing apparatus according to the prior art. This structure of racket string bracing apparatus comprises a string bracing mechanism (10) controlled to brace the string, and a racket frame holder assembly (20) controlled to hold down the racket frame to be strung. The string bracing mechanism (10) comprises a support (11), a locating wheel (13) revolvably mounted on the support (11), a lever (12) coupled to the locating wheel (13) for turning it, a one-way rotary wheel (14) connected to the locating wheel (13) in parallel, a fixed block (15) and the movable block (16) respectively mounted on the one-way rotary wheel (14) at one side opposite to the locating wheel (13). When in use, the string is inserted through the gap between the fixed block (15) and the movable block (16). When the lever (12) is turned downwards, the movable block (16) is forced by the string to close on the fixed block (15), and therefore the string is firmly retained to the one-way rotary wheel (14). This structure of racket string bracing apparatus is still not satisfactory in function. Each time the string is braced, the lever (12) must be turned upwards to release the string from the one-way rotary wheel (14) so that the string can be braced again. Therefore, the stringing of the string in the racket frame is complicated to perform. Another drawback of this structure of racket string bracing apparatus is that the string bracing mechanism (10) will deform with use quickly because it is fastened to one side of the support (11) by a screw bolt only and frequently pulled by the string in the direction toward the racket frame holder (20). Further, the racket frame holder assembly (20) is comprised of two locating arms (29) to held two symmetrical pairs of racket frame holders, each racket frame holder comprised of a plurality of two stop plates (21), a plurality of tie screws (22), a torsional spring (23), a pivot bolt (24), a screw red (25), a slide (26), a clamping plate (27), and a rod member (28). This structure of racket frame holder assembly (20) is complicated and heavy, thereby causing the manufacturing cost of the racket string bracing apparatus unable to be reduced. Furthermore, the locating arms (29) tend to be deformed after long uses.

SUMMARY OF THE INVENTION

This invention is related to an improved racket string bracing apparatus.

According to one aspect of the present invention, the racket string bracing apparatus comprises a base, a work table mounted on the base, two internal racket frame holders and two external racket frame holders respectively mounted on the work table to hold down the racket frame to be strung with a string, and a string bracing mechanism mounted on the work table and turned to stretch the string, wherein the base comprises a column sleeve at one end, which holds the work table, permitting the work table to be turned thereabout, and a substantially U-shaped upright support at an opposite end, which holds the string bracing mechanism; a pawl and a gear are mounted in the string bracing mechanism to prohibit it from reverse rotation. According to another aspect of the present invention, each external racket frame holder comprises a slide slidably mounted on the work table and fixed in place by a tightening up screw, a transverse sleeve welded to the slide, two horizontal extension bars respectively and longitudinally slidably inserted into two opposite ends of the transverse sleeve and fixed in place by a respective tightening up screw, and two stop rods respectively perpendicularly fastened to the horizontal extension bars at respective locations remote from the transverse sleeve.

DETAILED DESCRIPTION OF THE PREFERRED EMBODIMENT

Figure 1:
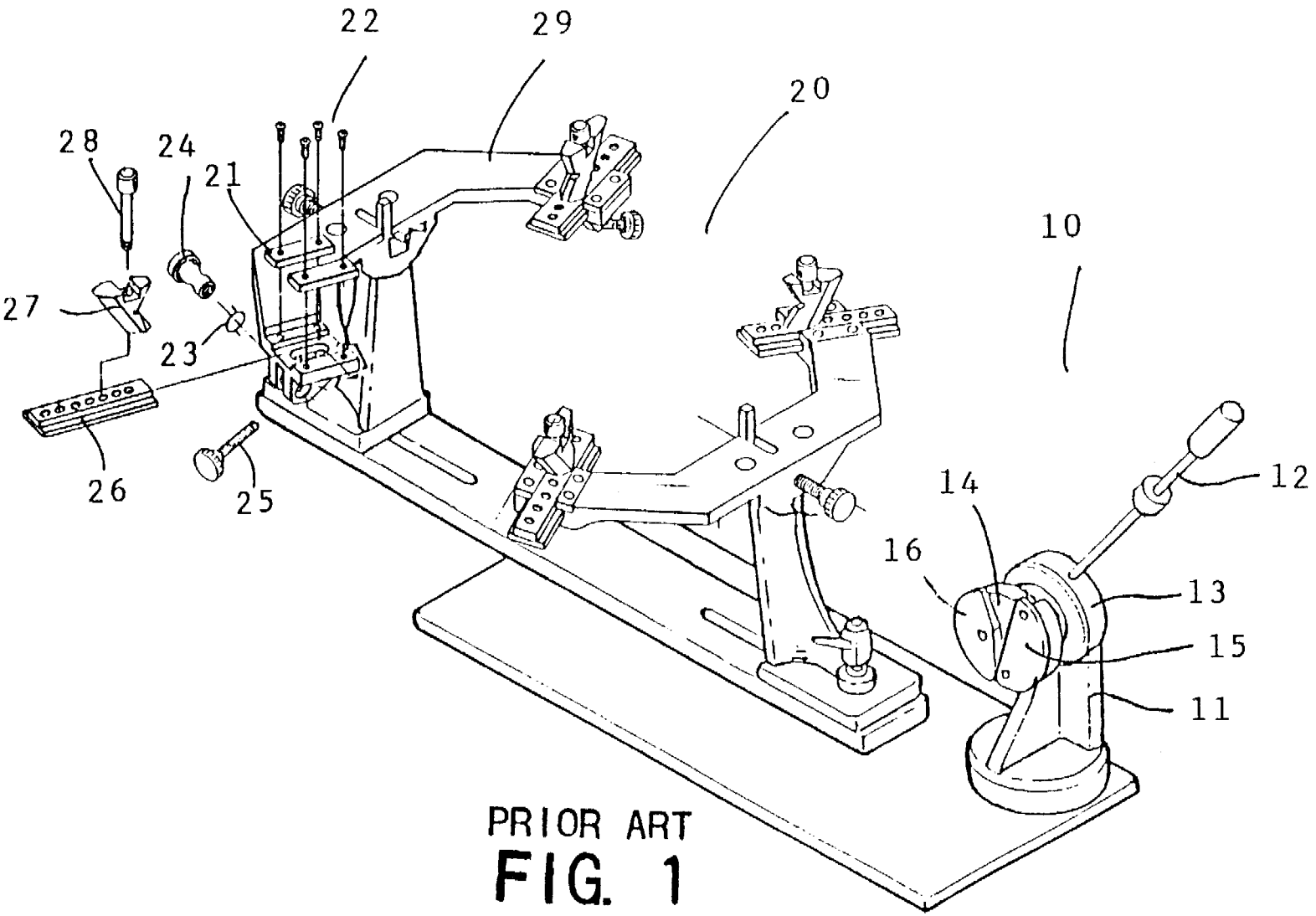
PRIOR ART FIG. 1
FIG. 1 is an elevational view of a racket string bracing apparatus according to the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
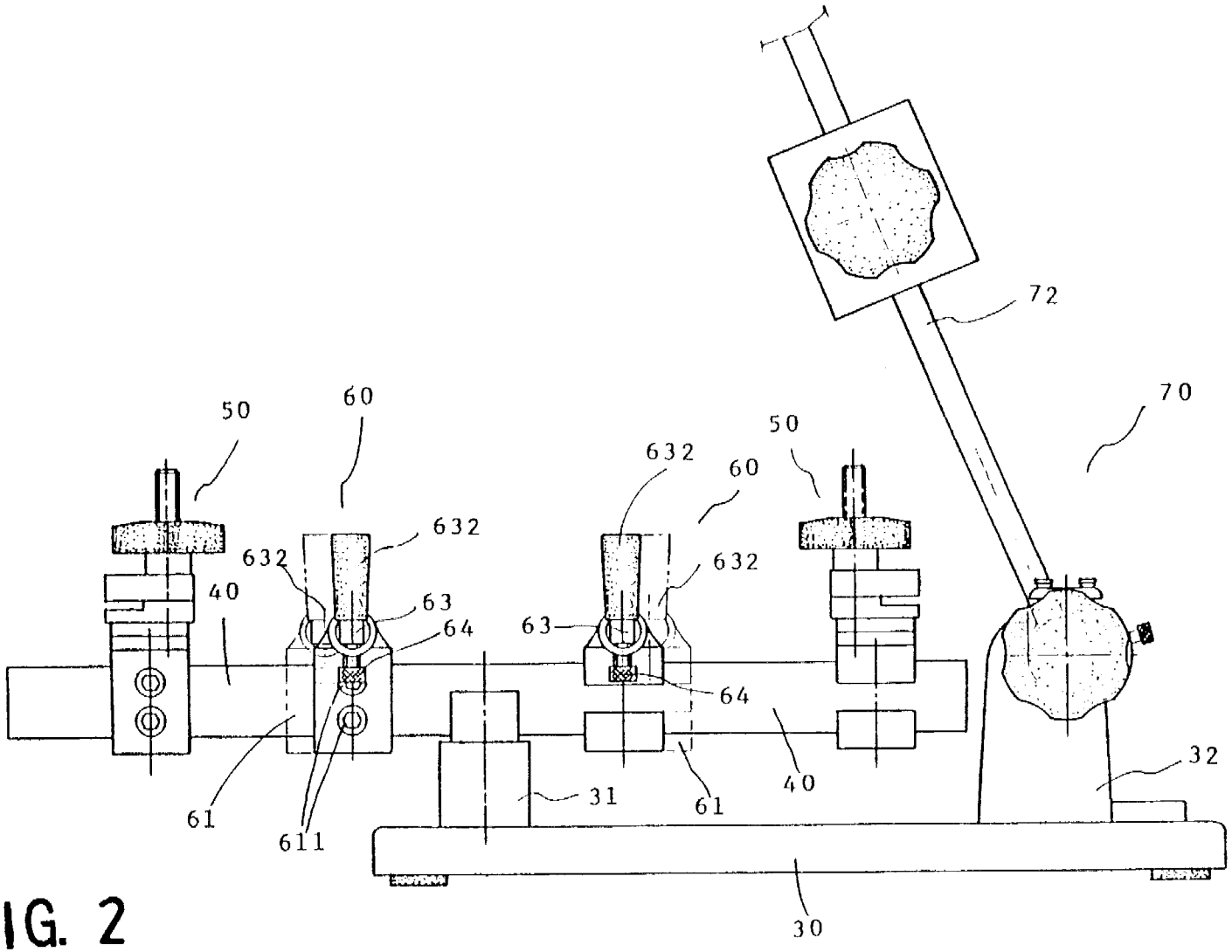
FIG. 2 is a front plain view of a racket string bracing apparatus according to the present invention.
Figure 3:
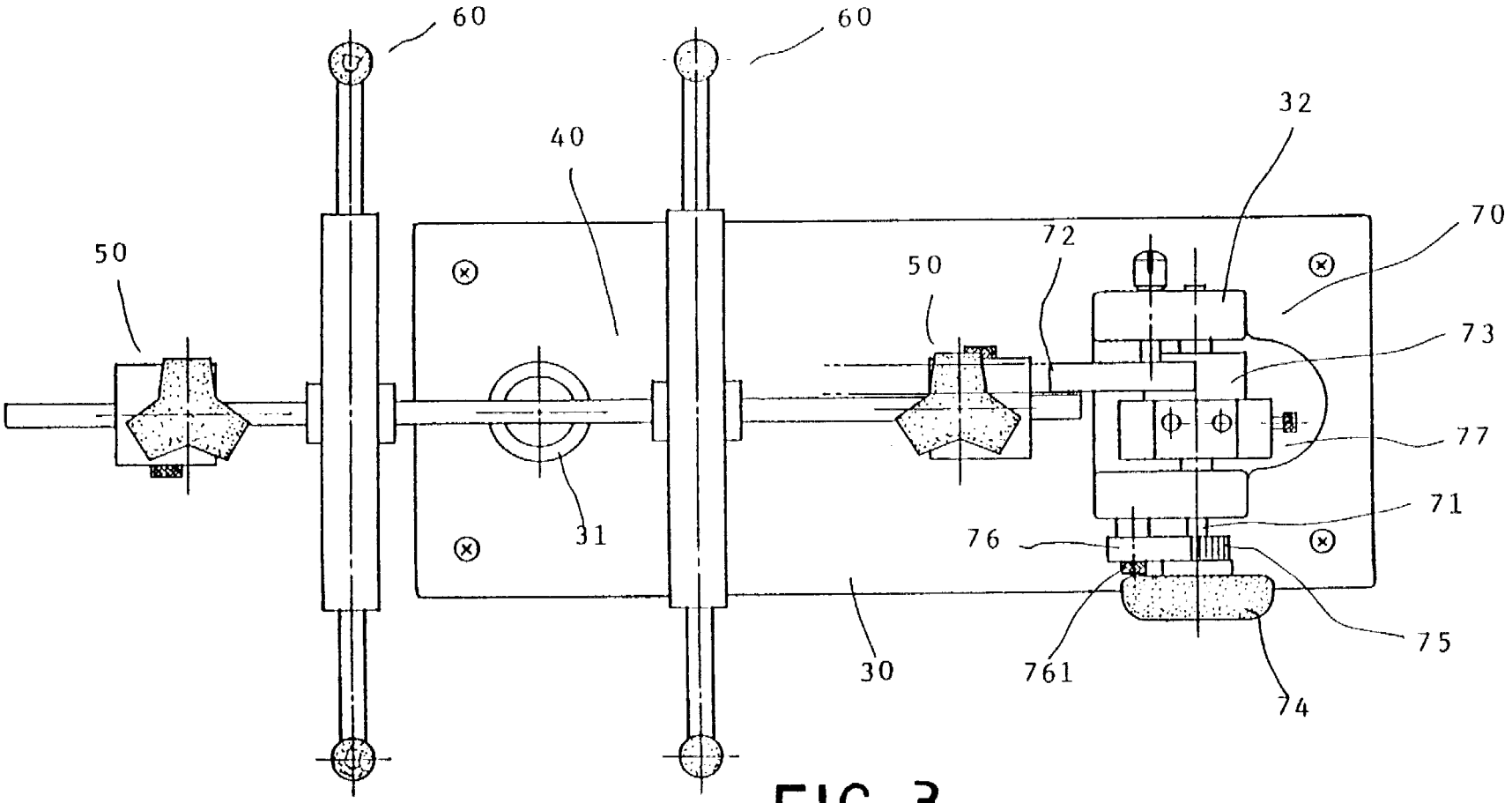
FIG. 3 is a top plain view of the racket string bracing apparatus shown in FIG. 2.
Figure 4:
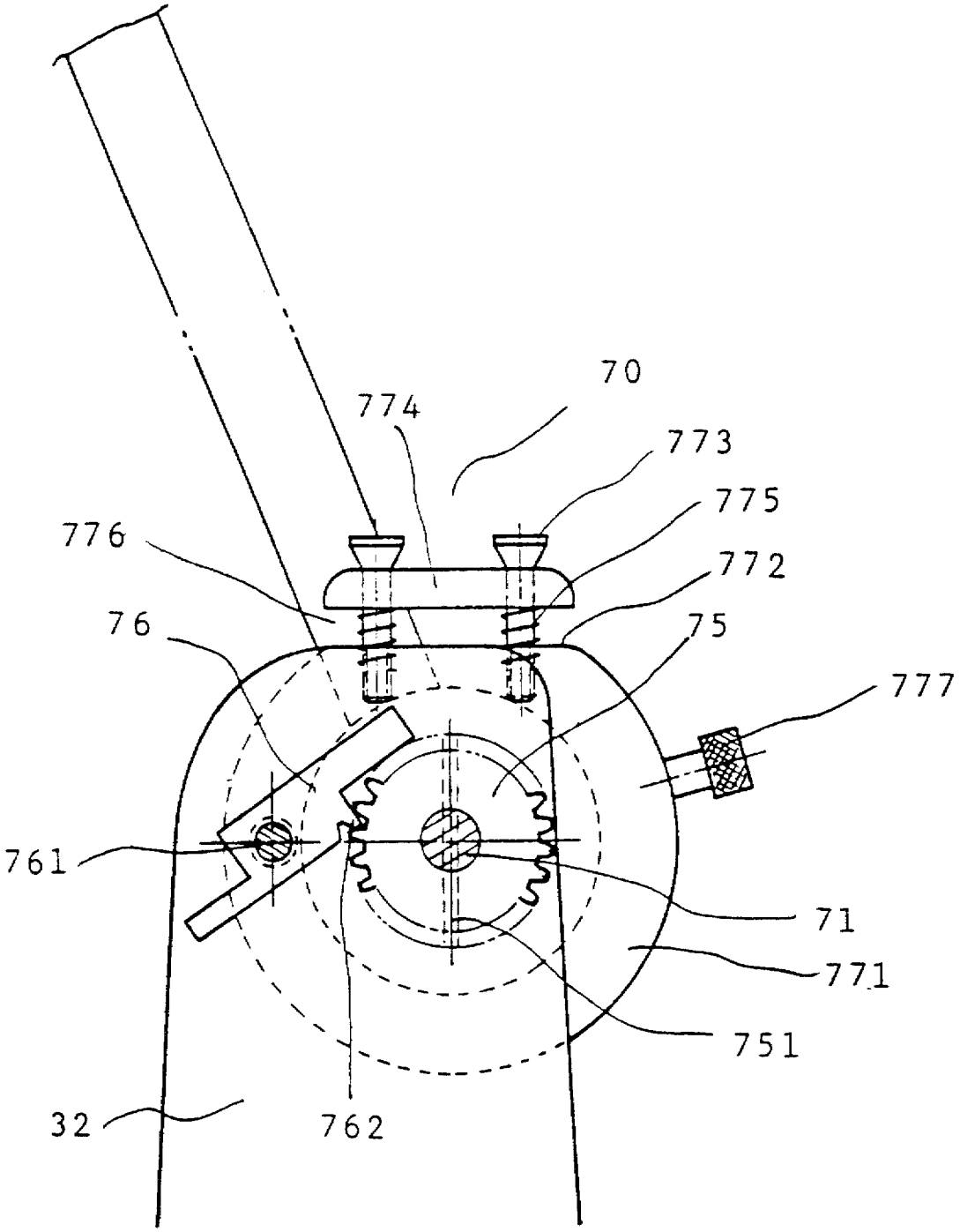
FIG. 4 shows the relationship between the pawl and the gear of the string bracing mechanism and the relationship between the press board and the string take-up wheel according to the present invention.

Referring to FIGS. 2, 3, and 4, a racket string bracing apparatus in accordance with the present invention is generally comprised of a base 30, a rotary work table 40, two internal racket frame holders 50, two external racket frame holders 60, and a string bracing mechanism 70. The base 30 comprises a column sleeve 31 at one end, and a substantially U-shaped upright support 32 at an opposite end. The rotary work table 40 is horizontally turned about the column sleeve 31 of the base 30. The string bracing mechanism 70 comprises an axle 71 horizontally mounted on the upright support 32 to hold a one-way rotary wheel 73, a hand wheel 74, a gear 75, and a string holding-down mechanism 77. A lever 72 is coupled to the one-way rotary wheel 73 for turning. The gear 75 is fixed to the axle 71 by a pin 751. A pawl 76 is pivoted to the upright support 32 by a bolt 761, having a tooth 762 forced into engagement with the gear 75. The string holding-down mechanism 77 comprises a string take-up wheel 771 having a plane 772 at the periphery, a press board 774 movably fastened to the plane 772 of the string take-up wheel 771 by two screws 773, two springs 775 respectively mounted around the screws 773 and stopped between the string take-up wheel 771 and the press board 774, and a locating screw 777 at the periphery away from the plane 772. The springs 775 force the press board 774 away from the string take-up wheel 771, and therefore a wire gap 776 is defined between the press board 774 and the string take-up wheel 771 for the passing of the string 80. The string 80 to be braced is moved over the press board 774 and the locating screw 777, then turned backwards through the wire gap 776.

Figure 5:
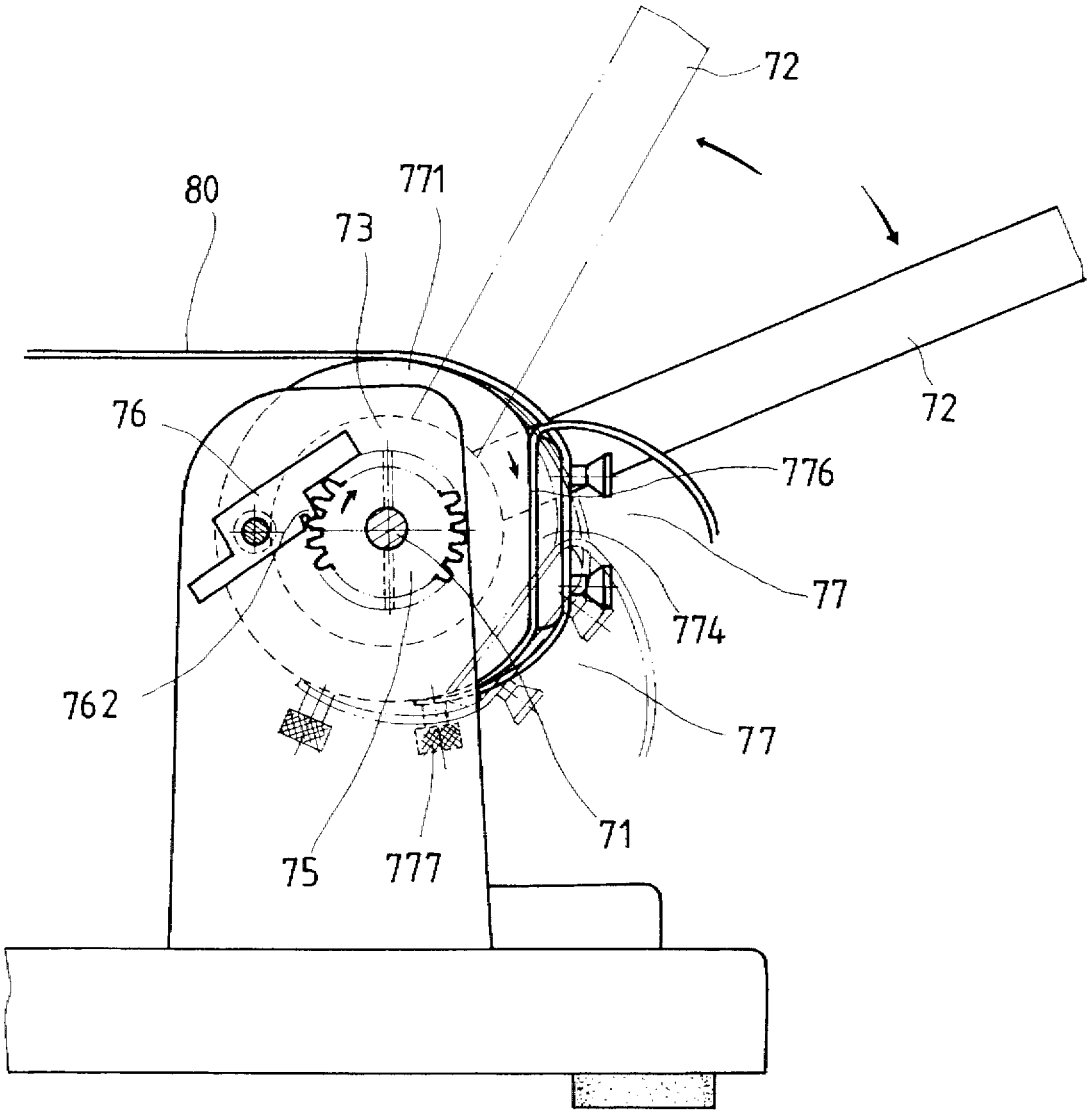
FIG. 5 is an operational view of the present invention, showing the string retained in place and stretched.
Figure 6:
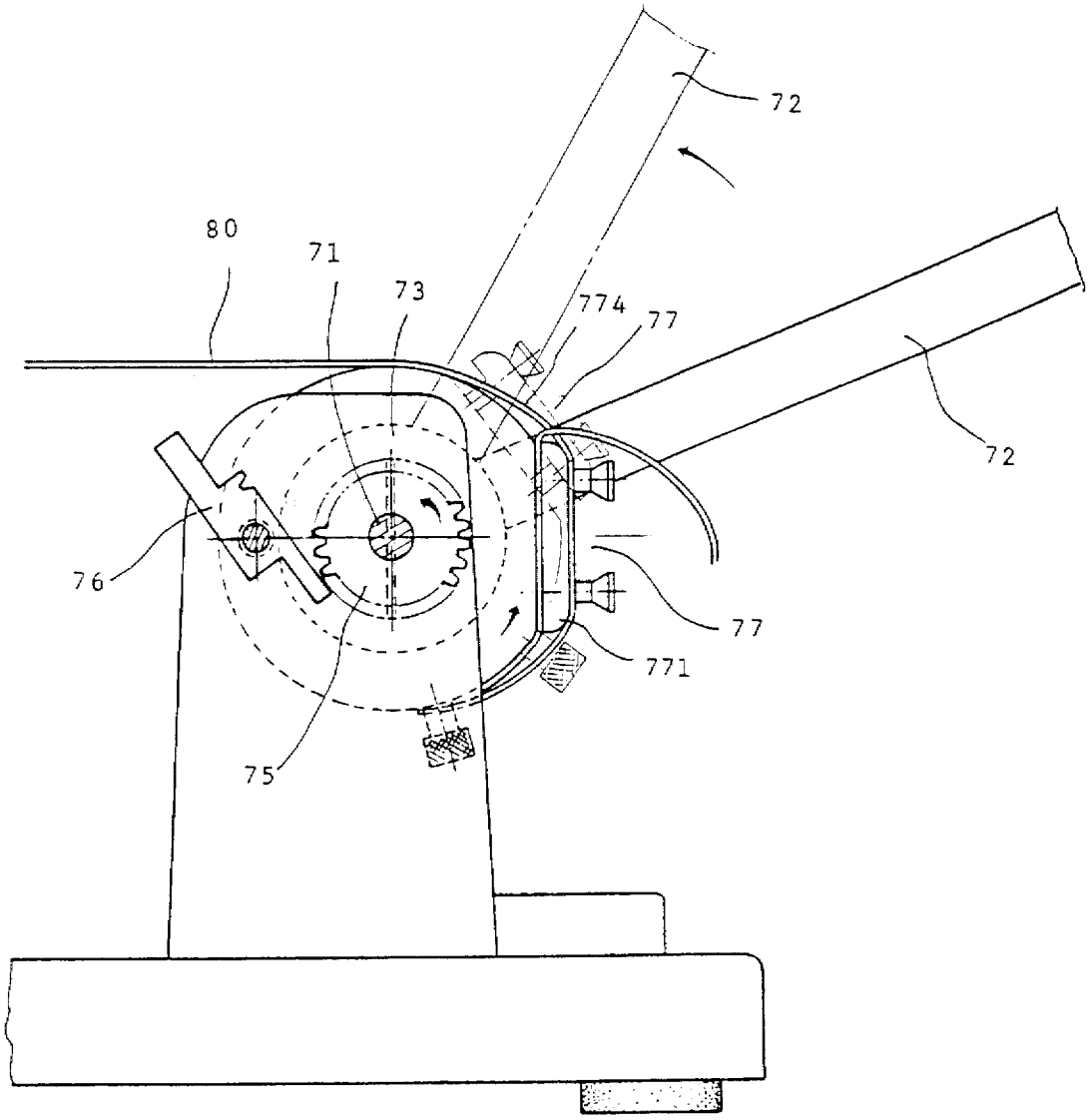
FIG. 6 is another operational view of the present invention, showing the pawl released from the gear.

Referring to FIGS. 5 and 6, when the hand wheel 74 is rotated forwards, the string take-up wheel 771 is simultaneously turned with the axle 71 to take up the string 80, causing the string 80 to be firmly retained in the wire gap 776 by the press board 774. Thus, the one-way rotary wheel 73 can then be turned by the lever 72 to turn the string take-up wheel 771, causing it to take up the string 80, and therefore the string 80 is stretched. When the tooth 762 of the pawl 76 is forced into engagement with the gear 75, the string holding-down mechanism 77 and the axle 71 are prohibited from reverse rotation with the one-way rotary wheel 73, i.e., the string holding-down mechanism 77 can only be moved forward to stretch the string 80, and is prohibited from reverse rotation to release the string 80. When the pawl 76 is released from the gear 75 as shown in FIG. 6, the gear 75, the axle 71, and the string holding-down mechanism 77 can then be turned in the reversed direction by the lever 672 through the one-way rotary wheel 73 to release the string 80 for a next stretching operation.

Figure 7:
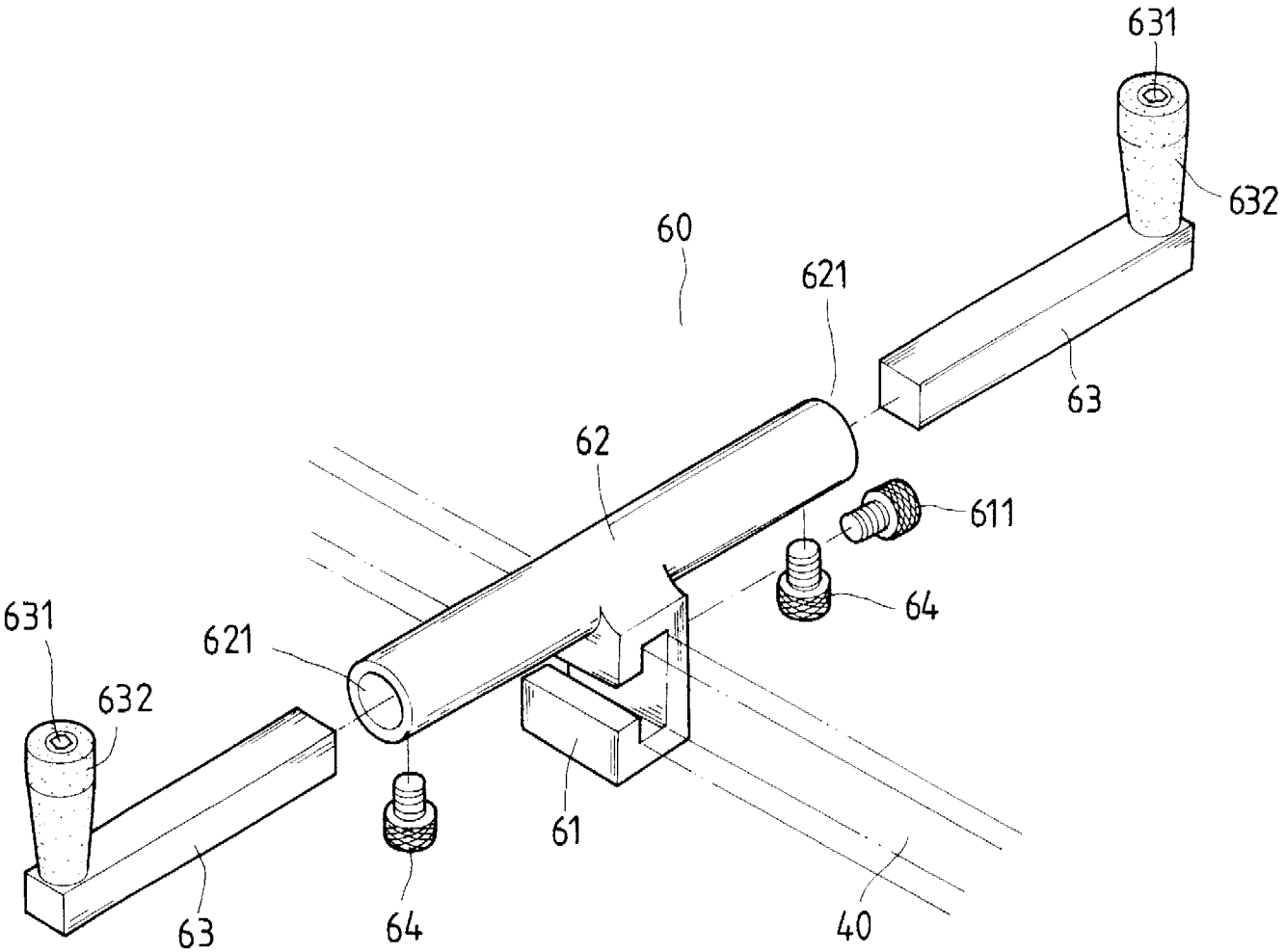
FIG. 7 is an exploded view of an external racket frame holder according to the present invention.
Figure 8:
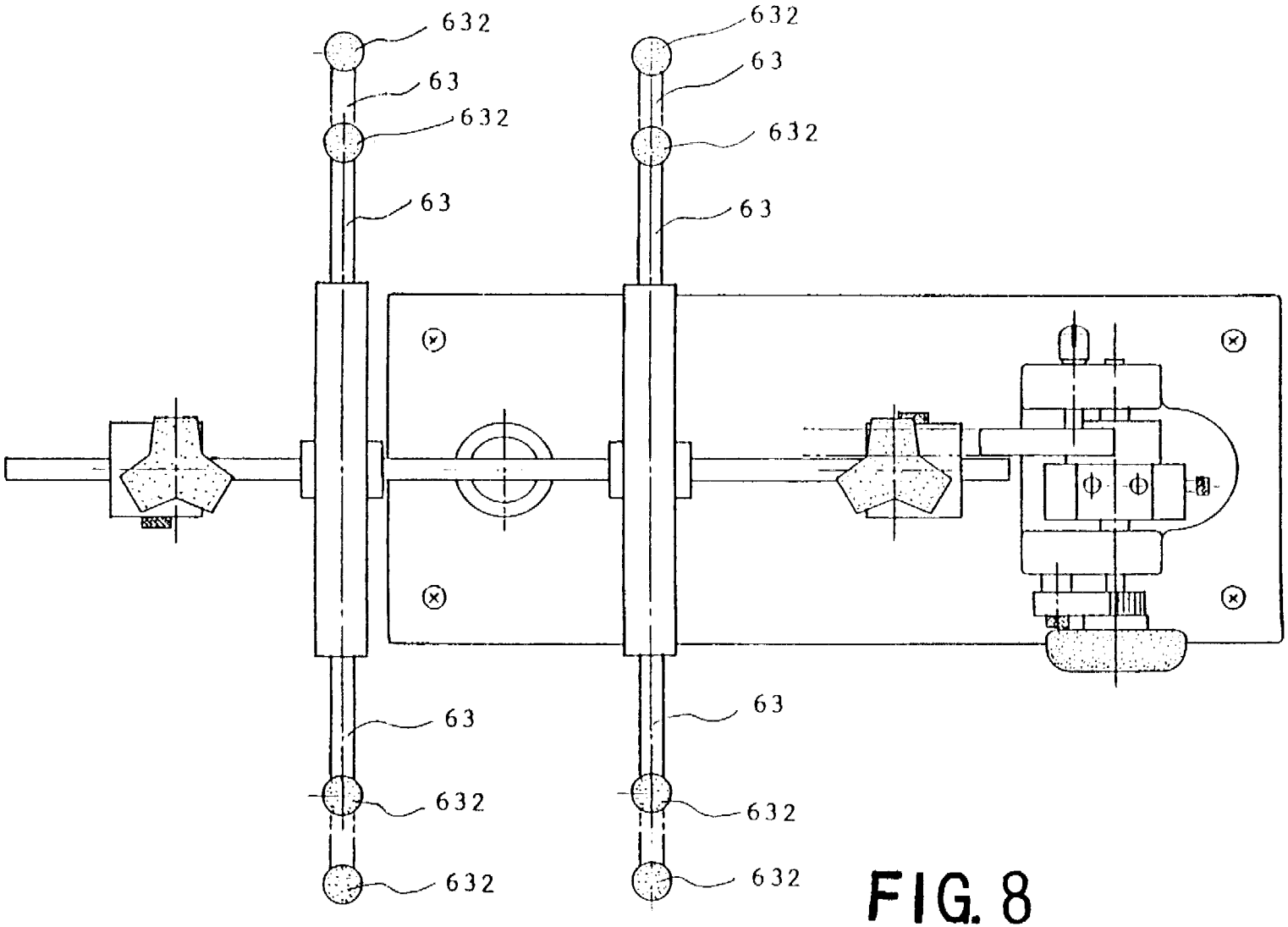
FIG. 8 is another plain view of the present invention, showing the extension bars of the external racket frame holders adjusted.

Referring to FIG. 7, the external racket frame holder 60 comprises a slide 61 slidably mounted on the work table 40 and fixed in place by a tightening up screw 611, a transverse sleeve 62 welded to the slide 61 at the top, two horizontal extension bars 63 respectively inserted into the bore 621 of the transverse sleeve 62 at two opposite ends and fixed in place by a respective tightening up screw 64, and two stop rods 632 respectively perpendicularly fastened to the horizontal extension bars 63 at respective locations remote from the transverse sleeve 62. When the tightening up screws 64 are loosened, the horizontal extension bars 63 can be moved longitudinally relative to the transverse sleeve 62 to adjust the pitch between the two stop rods 632 subject to the size of the racket frame.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A racket string bracing apparatus comprising a base, a work table mounted on said base, two internal racket frame holders and two external racket frame holders respectively mounted on said work table to hold down the racket frame to be strung with a string, and a string bracing mechanism mounted on said work table and turned to stretch the string, wherein:

said base comprises a column sleeve at one end, which holds said work table, permitting said work table to be turned thereabout, and a substantially U-shaped upright support at an opposite end, which holds said string bracing mechanism;

said string bracing mechanism comprises an axle horizontally mounted on the upright support of said base and turned on its own axis, a one-way rotary wheel mounted around said axle, a hand wheel fixedly mounted around said axle at one end, a gear fixedly mounted around said axle between said hand wheel and said one-way rotary wheel, a string holding-down mechanism fixedly mounted around said axle and controlled to hold down the string, a level coupled to said one-way rotary wheel for turning it, a pawl turned about a bolt on the upright support of said base and forced into engagement with said gear to stop said axle from reverse rotation;

each of said external racket frame holders comprises a slide slidably mounted on said work table and fixed in place by a tightening up screw, a transverse sleeve welded to said slide, two horizontal extension bars respectively and longitudinally slidably inserted into two opposite ends of said transverse sleeve and fixed in place by a respective tightening up screw, and two stop rods respectively perpendicularly fastened to said horizontal extension bars at respective locations remote from said transverse sleeve.

* * * * *